US006907340B2

(12) United States Patent
Desert

(10) Patent No.: US 6,907,340 B2
(45) Date of Patent: Jun. 14, 2005

(54) SYSTEM FOR MANAGING INFORMATION CONCERNING THE FUEL CONSUMPTION OF A MOTOR VEHICLE ENGINE

(75) Inventor: Thomas Desert, Le Perray En Yvelines (FR)

(73) Assignee: Peugot Citroen Automobiles SA, Velizy-Villacoublay (FR)

( * ) Notice: Subject to any disclaimer, the term of this patent is extended or adjusted under 35 U.S.C. 154(b) by 0 days.

(21) Appl. No.: 10/726,519

(22) Filed: Dec. 4, 2003

(65) Prior Publication Data

US 2004/0117103 A1 Jun. 17, 2004

(30) Foreign Application Priority Data

Dec. 11, 2002 (FR) ..... 02 15664

(51) Int. Cl.[7] ..... F02D 41/00
(52) U.S. Cl. ..... 701/104; 701/123; 123/480
(58) Field of Search ..... 701/104, 102, 701/123; 123/478, 480; 73/113, 114; 60/285, 278, 280

(56) References Cited

U.S. PATENT DOCUMENTS 6,453,731 B1 * 9/2002 Yaegashi ..... 73/113
6,615,579 B2 * 9/2003 Nishiyama ..... 60/285

FOREIGN PATENT DOCUMENTS

| | | | | |
|---|---|---|---|---|
| EP | 1 018 449 | | 7/2000 | |
| EP | 1 134 397 | | 9/2001 | |
| EP | 1 203 877 | | 5/2002 | |
| FR | 2 807 470 | | 10/2001 | |
| JP | 58-77128 A | * | 5/1983 | ..... F02D/5/02 |
| JP | 2004-190676 A | * | 7/2004 | ..... F02D/45/00 |

* cited by examiner

*Primary Examiner*—Hieu T. Vo
(74) *Attorney, Agent, or Firm*—Westerman, Hattori, Daniels & Adrian LLP

(57) ABSTRACT

In this system for managing information concerning the fuel consumption of an engine fitted with a purifier of its exhaust gases and operating under the control of a controller adapted to determine a first fuel quantity for injection into the engine during normal operation and a second fuel quantity for injection into the engine in order to trigger a stage of regenerating the purifier and connected via a data transmission network to a management unit for managing fuel consumption information including a display and a calculator, the controller is associated with an emitter for acting during a stage of regenerating the purifier to emit first and second fuel quantities in succession over the network and destined for corresponding receiver means of the management unit so as to deliver the first fuel quantity to the display and the second fuel quantity to the calculator.

3 Claims, 2 Drawing Sheets

Regeneration

Real fuel consumption

Fuel consumption sent over the network (8 bits)

Type of consumption(1 bit)

SYSTEM FOR MANAGING INFORMATION CONCERNING THE FUEL CONSUMPTION OF A MOTOR VEHICLE ENGINE

The present invention relates to a system for managing information concerning the fuel consumption of a motor vehicle engine.

More particularly, the invention relates to such a management system for the engine of a motor vehicle fitted with purification means for purifying its exhaust gases, operation of the engine being controlled by a controller adapted to determine a first fuel quantity for injection into the engine for normal operation, and a second fuel quantity for injection into the engine in order to trigger regeneration of the purification means.

BACKGROUND OF THE INVENTION

It is becoming more and more common practice to include purification means in the exhaust systems of vehicle engines for the purpose of purifying exhaust gases, such as particle filters, NOx traps, etc., for example.

By way of example, these purification means serve to trap undesirable polluting emissions and then to process them during a regeneration stage.

The regeneration stage needs to be triggered regularly, for example as a function of the load state in the purification means, with this being done by the controller that controls operation of the engine.

These various means are well known in the prior art and they are not described in greater detail below.

It should merely be observed that this regeneration is generally triggered by increasing the fuel quantity injected into the engine so as to enrich the air/fuel mixture, thereby causing the temperature of the exhaust gases to rise in order to trigger regeneration in the purification means, for example by triggering combustion of particles trapped in a particle filter.

Unfortunately, this engine fuel consumption information is also transmitted over an on-board data transmission network to other equipment of the vehicle, such as, for example, means for managing fuel consumption information.

By way of example, these means for managing fuel consumption information include means for displaying instantaneous fuel consumption information to the users of the vehicle, and means for calculating mean fuel consumption and vehicle range.

At present, during a regeneration stage of the purification means, the users of the vehicle looking at the display means perceive a significant increase in the fuel consumption for no apparent reason, and this frequently causes them to take the vehicle to the after-sales service of the corresponding manufacturer, complaining that something has gone wrong, when in fact this is not the case.

OBJECT AND SUMMARY OF THE INVENTION

The object of the invention is thus to solve these problems.

To this end, the invention provides a system for managing information concerning the fuel consumption of the engine of a motor vehicle fitted with purification means for purifying its exhaust gases, operation of the engine being controlled by a controller adapted to determine a first fuel quantity for injection into the engine for normal operation, and a second fuel quantity for injection into the engine in order to trigger a stage of regenerating the purification means, and connected by a data transmission network to means for managing fuel consumption information, said means comprising display means for displaying instantaneous fuel consumption information and calculation means for calculating mean consumption and vehicle range, wherein the controller is associated with emitter means for acting during a stage of regenerating the purification means to emit first and second determined fuel quantities in succession over the network and destined for corresponding receiver means of the management means so as to deliver the first fuel quantity to the display means and the second fuel quantity to the calculation means.

According to other characteristics:

- the first and second fuel quantities emitted over the network are associated with identity information; and
- the identity information is in the form of a single data bit associated with the fuel consumption information and taking on a first value for the first quantity and a second value for the second quantity.

BRIEF DESCRIPTION OF THE DRAWINGS

The invention will be better understood on reading the following description given purely by way of example and made with reference to the accompanying drawings, in which.

MORE DETAILED DESCRIPTION

Figure 1:
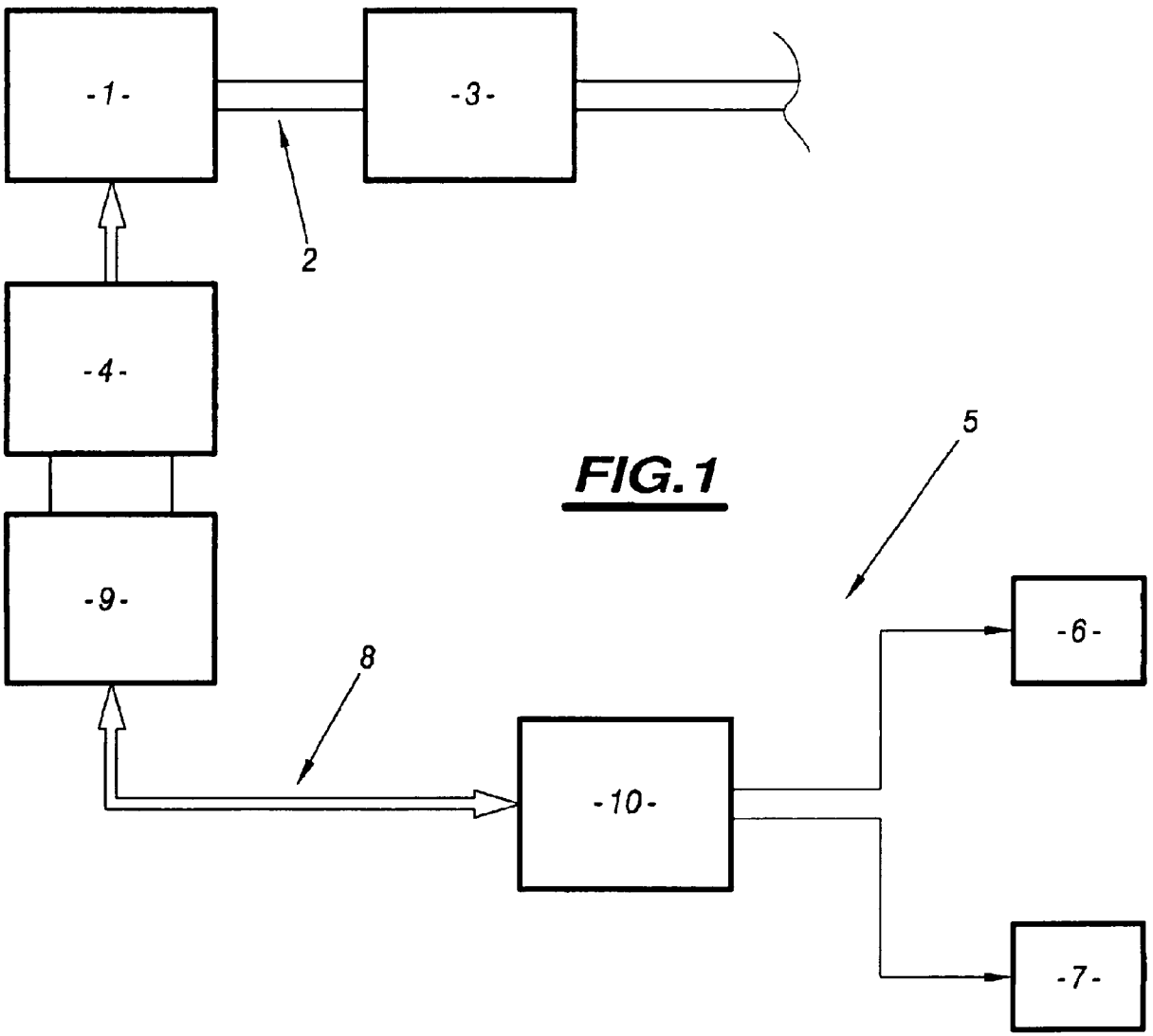
FIG. 1 is a block diagram showing the general structure of a management system of the invention.

FIG. 1 shows the general structure of a system for managing information concerning the fuel consumption of a motor vehicle engine.

In this figure, the engine is given general reference 1 and has an exhaust system given general reference 2 having integrated therein means 3 for purifying the exhaust gases from the engine.

By way of example, these purification means are constituted by a NOx trap, a particle filter, etc.

The operation of this assembly is controlled by a controller given general reference 4.

Depending on external requirements, this controller is adapted to determine the fuel quantity to be injected into the engine in order to satisfy the vehicle's needs.

As mentioned above, it is necessary to regenerate the purification means regularly.

This stage of regeneration is also triggered by the controller 4 on the basis of trigger information, such as the pollution load of the purification means, for example, etc.

These various means are well known in the prior art and are not described in greater detail below.

It should merely be observed that when the engine controller has detected the need to regenerate the purification means, it determines a different fuel quantity for injection into the engine, which quantity is greater than that required for normal operation of the engine, so as to cause the air/fuel mixture to become richer, thereby increasing the temperature of its exhaust gases, with this increase in temperature serving to encourage regeneration of the purification means.

Thus, for example, such an increase in the temperature of the exhaust gases can cause the pollutants trapped in the purification means to be raised to their combustion temperature. This applies, for example, to particles trapped in a particle filter.

Furthermore, as mentioned above, the controller of engine operation is also connected to means for managing consumption information, given overall reference 5 in the figure, these means comprising, for example, means for displaying information concerning the instantaneous fuel consumption of the engine, given overall reference 6, and means for calculating the mean fuel consumption of the vehicle and its range, given overall reference 7.

These display means comprise, for example, a display integrated in the vehicle dashboard for delivering information concerning instantaneous fuel consumption of the engine to the users thereof, while the calculation means can be formed by any suitable calculator, for example.

The engine controller and its management means are connected together by a data transmission network given overall reference 8 in the figures, e.g. formed by a multiplexed network.

To solve the above-described problems in the management system of the invention the engine controller 4 is associated with emitter means 9 for acting during a regeneration stage of the purification means to issue successively over the network first and second fuel quantities as determined by the controller, the first quantity, i.e. the quantity determined for normal operation of the engine being destined for the display means 6, and the second quantity, i.e. the quantity determined for regenerating the purification means being destined for the calculation means 7.

It will thus be understood that these first and second fuel quantities as determined by the controller are sent by the controller to the emitter means 9 which issues them in succession over the network 8.

The management means are associated with corresponding receiver means 10 for identifying the nature of the information concerning fuel quantity received from the controller over the network, and for applying said information to the corresponding means, i.e. to the display means or to the calculation means.

During a regeneration stage, the display means 6 thus receive the first quantity for display, while the calculation means receive the second quantity for the remainder of the calculations concerning average fuel consumption and range.

This operation is illustrated by FIGS. 2, 3, 4, and 5.

Figures 2, 3, 4, 5:
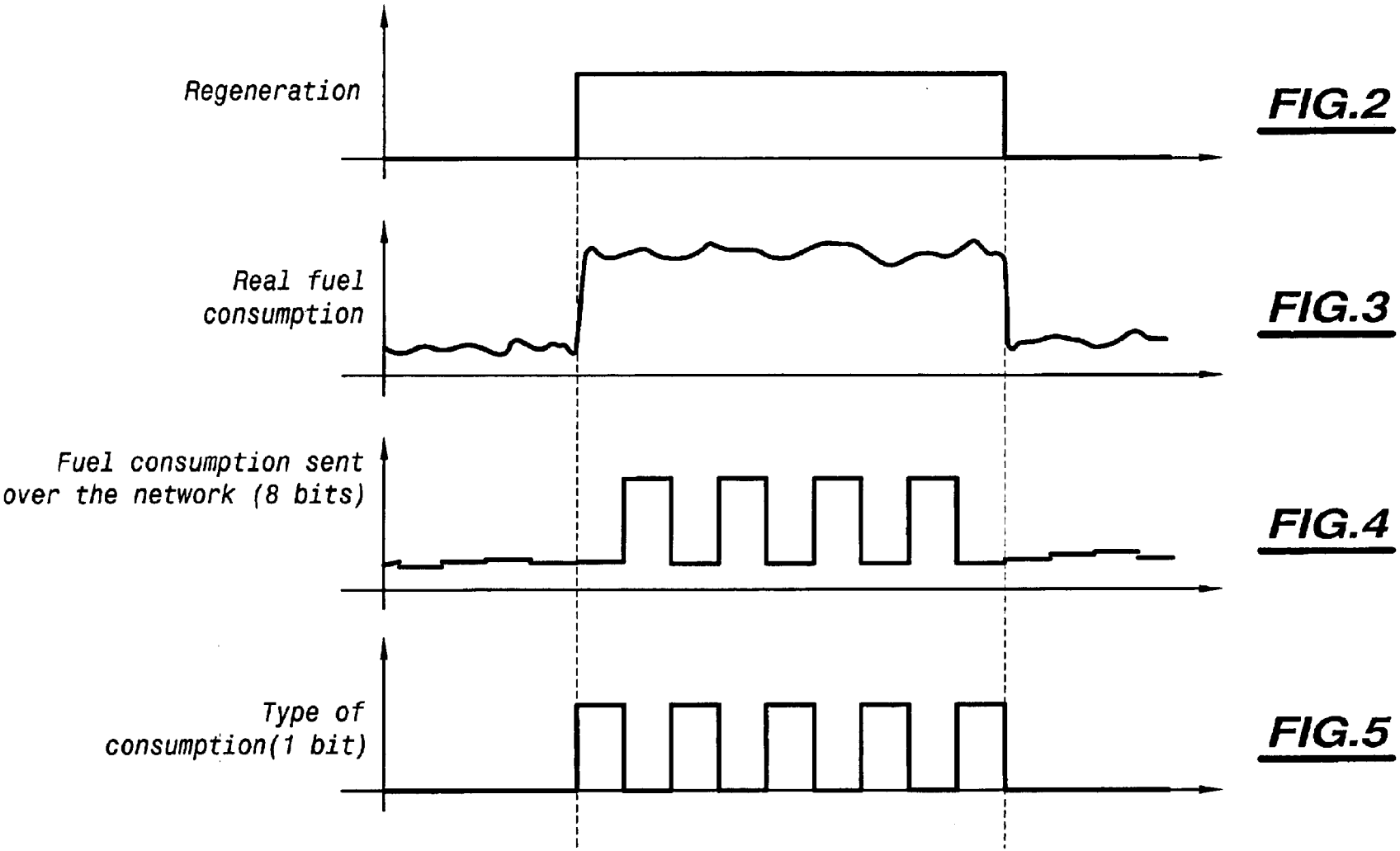
FIGS. 2 to 5 illustrate operation of the system.

FIG. 2 shows the triggering of regeneration which is implemented, as can be seen in FIG. 3, by increasing the quantity of fuel that is injected into the engine.

FIG. 4 shows information concerning the fuel quantities for injecting into the engine for normal operation and for regeneration being emitted successively and in alternation.

As mentioned above, the first and second fuel quantities emitted over the network are identified by the corresponding receiver means 10 associated with the management means.

This information can be associated with corresponding identity information which, as shown in FIG. 5, can be formed by a single data bit, associated with the fuel quantity information, this bit taking a first value for the first fuel quantity and a second value for the second fuel quantity.

Thus, for the case when the identity bit is at 1, for example, the quantity being transmitted corresponds to the quantity of fuel to be injected for normal operation of the engine, whereas when the data bit is at zero, the quantity being transmitted is the quantity for injection in order to regenerate the purification means.

This makes it possible to identify in the transmitted information which fuel consumption information is destined for the display means and which fuel consumption information is destined for the calculation means.

The display means then receive information concerning normal engine consumption, thus avoiding the above-mentioned problems, while the calculation means receive real engine fuel consumption information during regeneration stages, thus making it possible to conserve the accuracy with which mean fuel consumption is calculated and also the accuracy with which vehicle range is calculated.

Naturally, other embodiments could be envisaged.

What is claimed is:

1. A system for managing information concerning the fuel consumption of the engine of a motor vehicle fitted with purification means for purifying its exhaust gases, operation of the engine being controlled by a controller adapted to determine a first fuel quantity for injection into the engine for normal operation, and a second fuel quantity for injection into the engine in order to trigger a stage of regenerating the purification means, and connected by a data transmission network to means for managing fuel consumption information, said means comprising display means for displaying instantaneous fuel consumption information and calculation means for calculating mean consumption and vehicle range, wherein the controller is associated with emitter means for acting during a stage of regenerating the purification means to emit first and second determined fuel quantities in succession over the network and destined for corresponding receiver means of the management means, so as to deliver the first fuel quantity to the display means and the second fuel quantity to the calculation means.

2. A system according to claim 1, wherein the first and second fuel quantities emitted over the network are associated with identity information.

3. A system according to claim 2, wherein the identity information is in the form of a single data bit associated with the fuel consumption information and taking on a first value for the first quantity and a second value for the second quantity.

* * * * *